US005280978A

United States Patent [19]

Bohn

[11] Patent Number: 5,280,978

[45] Date of Patent: Jan. 25, 1994

[54] CONTAINER DEVICE FOR THE COLLECTION OF WASTE

[76] Inventor: Jamie Bohn, 18415 Chatham La., Northridge, Calif. 91326

[21] Appl. No.: 984,845

[22] Filed: Dec. 3, 1992

Related U.S. Application Data

[63] Continuation of Ser. No. 784,636, Oct. 28, 1991, abandoned, which is a continuation of Ser. No. 588,005, Sep. 25, 1990, abandoned.

[51] Int. Cl.[5] ..... A01K 29/00

[52] U.S. Cl. ..... 294/1.3; 294/25

[58] Field of Search ..... 294/1.1, 1.3–1.5, 294/25, 55, 131; 15/104.8, 257.1, 257.4, 257.6, 257.7, 227; 119/95, 161, 165, 168; 206/223, 496; 248/99; 383/4, 33, 34

[56] References Cited

U.S. PATENT DOCUMENTS

| | | | |
|---|---|---|---|
| 3,767,247 | 10/1973 | Wetzler | 294/1.3 |
| 3,806,984 | 4/1974 | Hilsabeck | 294/1.3 |
| 3,813,121 | 5/1974 | Marvin | 294/1.3 |
| 3,837,696 | 9/1974 | Dahlke | 294/1.3 |
| 3,850,467 | 11/1974 | Johnson | 294/1.3 |
| 4,103,952 | 8/1978 | Thompson | 294/1.3 |
| 4,132,442 | 1/1979 | Larsson | 294/1.3 |
| 4,138,153 | 2/1979 | Brown | 294/1.3 X |
| 4,230,354 | 10/1980 | Claras | 294/1.3 |
| 4,458,932 | 7/1984 | Resch | 294/1.3 |
| 4,645,251 | 2/1987 | Jacobs | 294/1.3 |
| 4,677,697 | 7/1987 | Hayes | 294/1.3 X |
| 4,741,565 | 5/1988 | Bagg | 294/1.3 |
| 4,752,093 | 6/1988 | Haber et al. | 294/1.3 |
| 4,768,818 | 9/1988 | Kolic | 294/1.3 |
| 4,788,733 | 12/1988 | Lerner | 294/1.3 X |
| 4,838,327 | 6/1989 | Ambler et al. | 294/1.3 X |
| 4,845,781 | 7/1989 | Strickland et al. | 294/1.3 X |
| 4,909,553 | 3/1990 | Hantover | 294/1.3 |
| 5,000,500 | 3/1991 | Almog | 294/1.3 |

FOREIGN PATENT DOCUMENTS

| | | | |
|---|---|---|---|
| 3518908 | 11/1986 | Fed. Rep. of Germany | 294/1.3 |
| 1150742 | 4/1969 | United Kingdom | 294/1.3 |

OTHER PUBLICATIONS

"Dispoz-A-Scoop" Advertisement, Petpro Products, Inc., Los Angeles, Calif. 90067 (1987).

"Scoop It" Advertisement, Engsol Corporation, Mississauga, Ontario L5A 2X2.

*Primary Examiner*—Johnny D. Cherry

*Attorney, Agent, or Firm*—Marshall, O'Toole, Gerstein, Murray & Borun

[57] ABSTRACT

The present invention is a container device. It is comprised of a flexible container with a firm flexible collar around the opening. The collar is used to scoop the waste into the container. The collar can open, close and manipulate the shape of the opening to the container. The device also has a protective skirt of flexible material that surrounds it and protects the user and the container from contamination. The skirt contains a closure such as a draw string or adhesive tape. After use, the skirt is pulled back over the container and closed. The device is folded and packaged in a packaging-tool. The packaging-tool is a strong rigid sleeve in which the device is enclosed that is used to hold the waste in place when scooping.

19 Claims, 10 Drawing Sheets

CONTAINER DEVICE FOR THE COLLECTION OF WASTE

This is a continuation of application Ser. No. 07/784,636, filed Oct. 28, 1991, now abandoned, which is a continuation of application Ser. No. 07/588,005, filed Sep. 25, 1990, now abandoned.

BACKGROUND

1. Field of Invention

This invention relates to a container device for the collection of pet waste and other noxous materials.

2. Description of Prior Art

A primary application of this invention is the collection of dog waste. It is estimated that in the United States there are more than 50 million dogs, that produce more than 5 thousand tons of waste per day. Most major municipalities have pet waste laws ("scooper laws") in an attempt to alleviate some of this problem. Unfortunately, no product exists that allows pet owners to conveniently, effectively, and efficiently clean-up after their pet (e.g., their dog). All devices designed heretofore to address this problem are ineffective and inconvenient to use.

Collecting devices such as Marvin U.S. Pat. No. 3,813,121 (1974), and scooping devices such as Johnson U.S. Pat. No. 3,850,467 (1974) and Bagg U.S. Pat. No. 4,741,565 (1988), are too large to conveniently fit into one's pocket and require hand carrying. These scoop devices have no way to compensate for the movement of waste and are awkward to use when the waste is in more than one mass. These collecting devices are ineffective when the waste (or stool) is loose and are awkward to use when the waste is in more than one mass, requiring the compiling of said waste in order to collect it.

the scooping device of Dahlke U.S. Pat. No. 3,837,696 (1974) has a very limited capacity and is very difficult and messy to use when the waste is of significant volume.

Glove or glove-like devices such as Jacobs U.S. Pat. No. 4,645,251 (1987), Hayes U.S. Pat. No. 4,677,697 (1987), and Kolie U.S. Pat. No. 4,768,818 (1988) are inconvenient because they expose the user to the texture and sometimes the temperature of the waste. These glove and glove-like devices: 1) restrict the volume of waste that can be picked up to the size of the user's hands, 2) require the user to combine waste that is deposited in several locations in order to pick-up the entire mass, and 3) are difficult to use when waste is loose.

A waste collecting device that is on the market ("DISPOS-A-SCOOP") is also a scooping device. It suffers from a large fixed profile that requires hand carrying. It has a relatively small opening that will not accommodate some waste configurations. Used as instructed, the outside of the container becomes contaminated and it provides no means for compensating for waste movement.

"Scoop-It" is another scooping device that is on the market. It is a large molded plastic apparatus which is covered with a flexible plastic sleeve to keep it clean and capture the waste. It is inconvenient to carry and difficult to use when the waste is loose or in several masses.

OBJECTIVES AND ADVANTAGES

The objectives and advantages of my invention are:

1) It is a small, light-weight container device that will easily fit into clothing pockets, making it easy and convenient to carry.

2) It is a container device with the means of quickly and efficiently scooping or picking-up waste.

3) It is a container device capable of collecting almost any reasonable volume of waste.

4) It is a container device capable of easily picking up waste regardless of its configuration or number of masses.

5) It is a container device that protects the user from accidental contamination during and after utilization.

6) It is a container device that is easy to close and clean to carry after use.

7) It is a container device that includes the means for handling the movement of waste when scooping.

8) It is a container device that is inexpensive to manufacture and purchase.

SUMMARY OF THE INVENTION

The present invention is a container device. It is comprised of a flexible container with a firm flexible collar around the opening. The collar is used to scoop the waste into the container. The collar can open, close and manipulate the opening to the container. The device also has a protective skirt of flexible material that surrounds it and protects the user and the container from contamination. The skirt contains a closing means, such as a draw string or adhesive tape. After use, the skirt is pulled back over the container and closed. The device is folded and packaged in a packaging-tool. The packaging-tool is a packaging means of sufficient strength to hold the waste in place when scooping and assist in it's collection.

BRIEF DESCRIPTION OF THE DRAWINGS

The drawings reflect different embodiments of the container device. In the drawings, closely related figures have the same number, but different alphabetic suffixes.

FIG. 6A shows the removal of the container device from the packaging-tool.

FIG. 6B shows the inserting of the hand between the container and the skirt to grasp the collar.

FIG. 6C shows the scooping-up of waste.

FIG. 6D shows the depositing of the packaging-tool into container.

FIG. 6E shows the closing of the container device.

REFERENCE NUMERALS IN DRAWINGS

The letter A shall be used after the following numbers to designate the same elements in the simple embodiment.

| | | |
|---|---|---|
| 11 sealed edge | 12 sealed edge | 13 sealed edge |

-continued

| | | |
|---|---|---|
| 14 open edge | 15 recessed finger area or gripping means | |
| 16 sealed edge | 17 sealed edge | 18 sealed edge |
| 19 open edge | 20 container | 25 collar |
| 30 skirt | 35 closing means | 40 packaging-tool |

DESCRIPTION OF THE PREFERRED EMBODIMENTS

Figure 1:
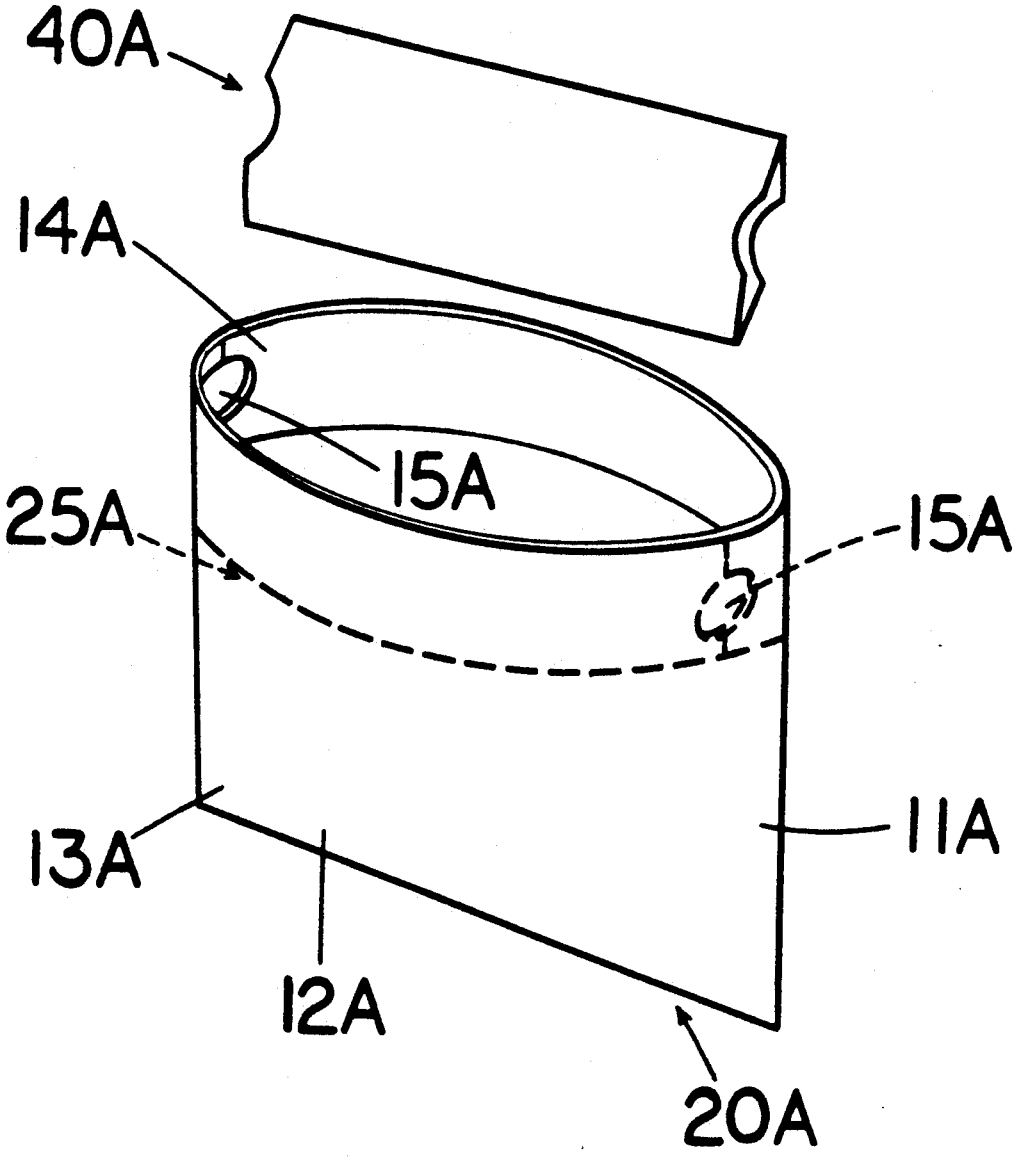
FIG. 1 shows a prospective view of a simple embodiment.
Figure 2:
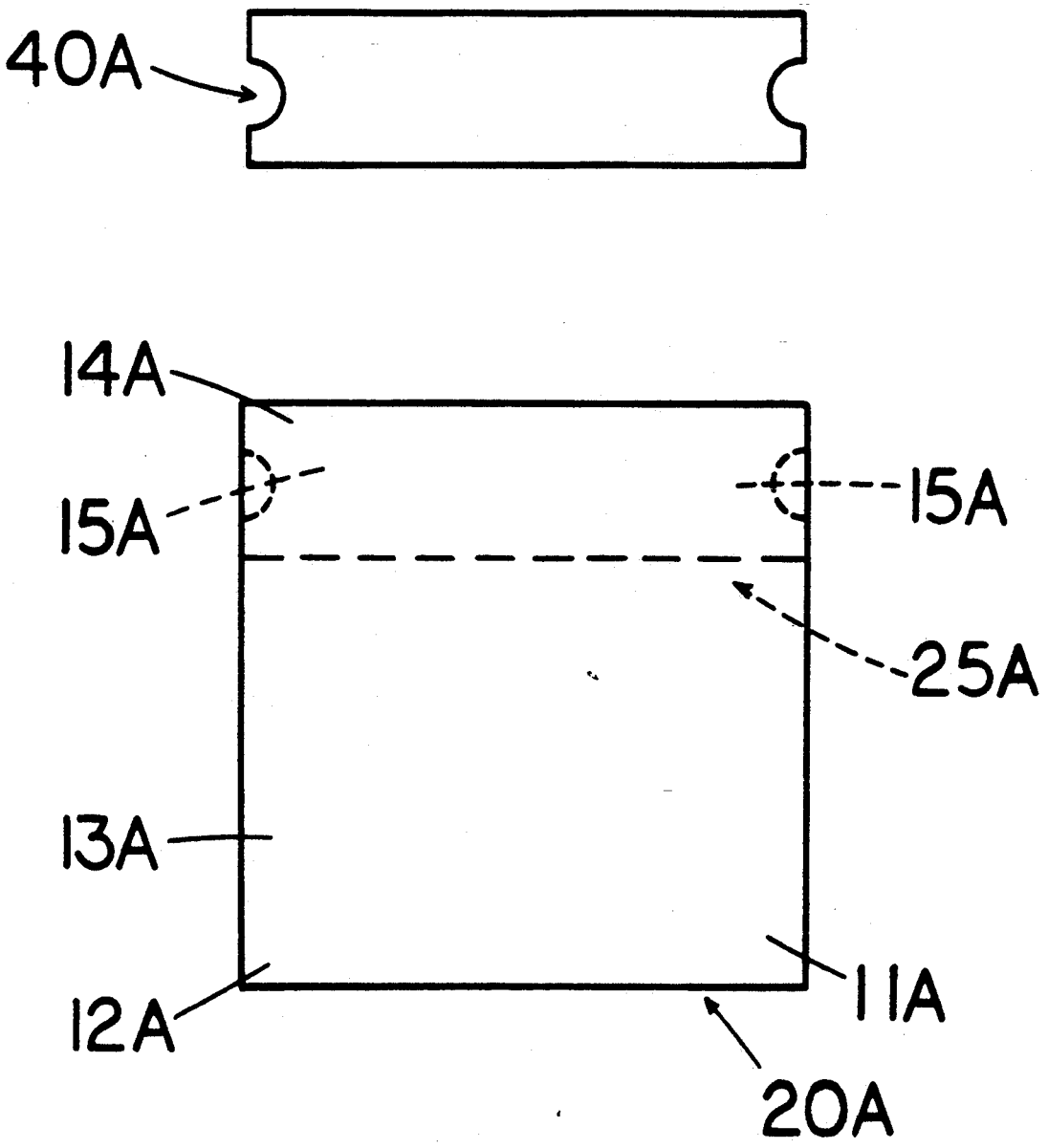
FIG. 2 shows an engineering view of a simple embodiment.

FIGS. 1 and 2. In a simple embodiment, as shown in FIGS. 1 and 2, the container device consists of a container 20A and a collar 25A and a packaging-tool 40A. The container 20A consists of two equal rectangular pieces of flexible material closed or sealed together at the edges on three sides 11A, 12A, 13A. It is open on the fourth side 14A to create a pocket into which waste is collected. The collar 25A is comprised of two flat rectangular strips of a firm, flexible material which are respectively bonded or affixed to opposite sides, at the edge of the open side 14A of the container 20A. The strips have opposite ends. The length of the strips is parallel and their width is perpendicular to the open side of the container. They form a collar-like band at the opening of the container 20A through which the waste passes. They have recessed finger areas 15A at each end. The collar 25A may be made of any firm flexible material capable of scooping up waste and flexible enough to repeatedly bend without cracking or breaking. The container 20A is folded around the collar 25A and inserted into the packaging-tool 40A. The packaging-tool 40A is a rigid chipboard sleeve which surrounds the container device and is open at the ends. It contains recessed cut-out areas at the ends to facilitate the removing of the device.

Figure 3:
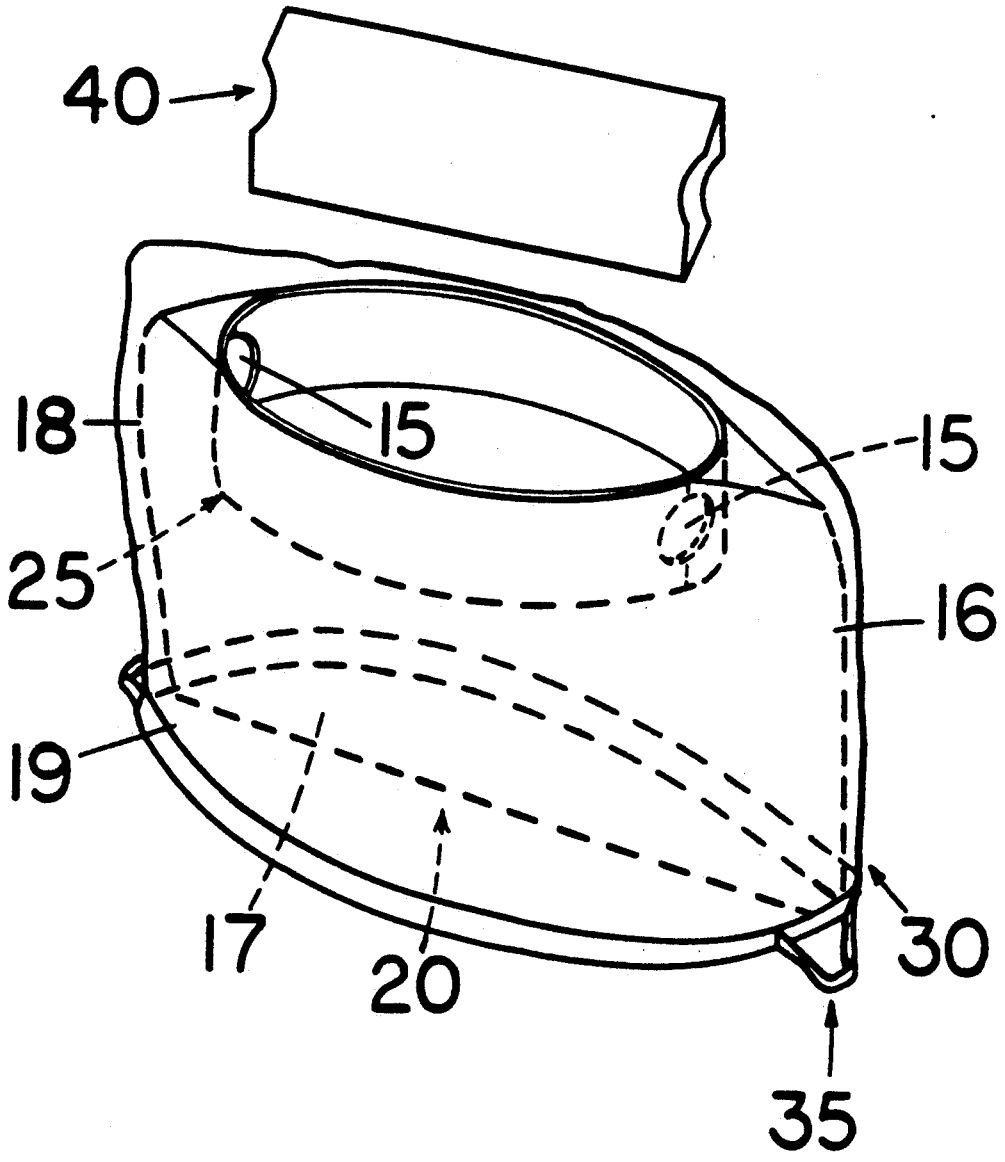
FIG. 3 shows a prospective view of a preferred embodiment.
Figure 4:
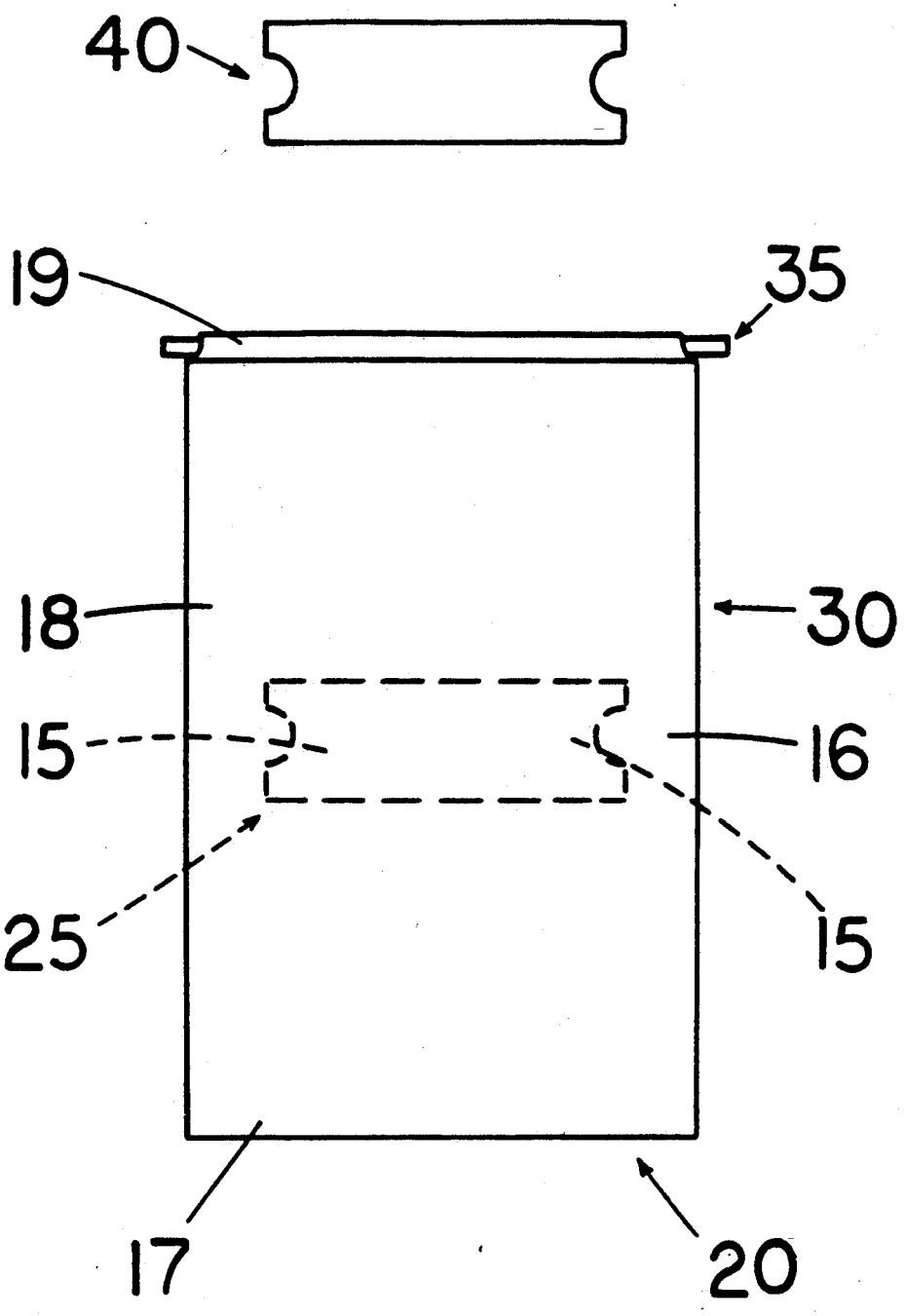
FIG. 4 shows an engineering view of a preferred embodiment, unfolded.
Figure 5:
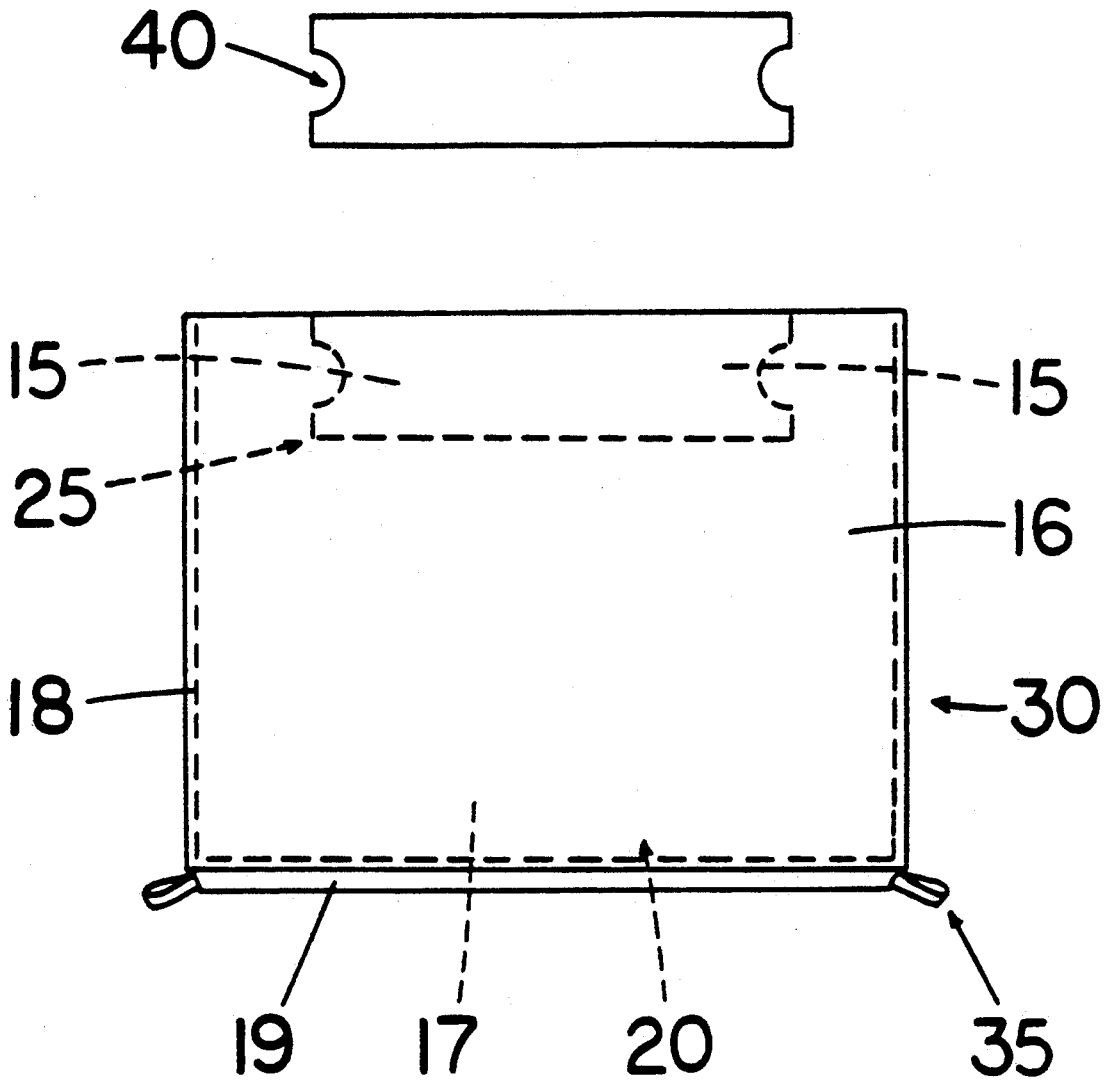
FIG. 5 shows an engineering view of a preferred embodiment, folded.

FIGS. 3,4, and 5. In a preferred embodiment, the container device is comprised of a container 20, a collar 25, a skirt 30, a closing means 35 and a packaging-tool 40. In this preferred embodiment, as shown in FIGS. 3,4, and 5, the container device is constructed from two rectangular sheets of flexible material, closed or sealed together on three sides 16,17,18 and open on the fourth side 19. The container 20 and the skirt 30 are constructed by reversing the material part-way, back-over itself. The material is folded back-over itself to the collar 25. In this embodiment, the collar 25 is constructed from a single flat rectangular piece of a firm flexible material folded in half and bonded together at the open end. The collar has opposite ends. The length of the collar is parallel and the width is perpendicular to the open end of the container. The collar 25 contains recessed finger areas 15 at the ends to facilitate gripping. It is bonded or affixed in the vertical center and below the horizontal center of the material (away from the open end). This placement causes the skirt 30 to be longer than the container 20. A draw-string closing means 35 is added to the end of the open side 19 of the material. In this embodiment, the material is wider than the collar 25. This allows space between the outer edges of the collar 25 and the sealed edges 16,18 of the material for the user to insert his hand and increases the load capacity of the container. The material is folded around the collar 25 and inserted into the packaging-tool 40. The packaging-tool 40 is a rigid chipboard sleeve which surrounds the device and is open at the ends. It contains recessed cut-out areas 15 at the ends to make it easier to remove the device.

There are a variety of ways to manufacture this invention. It may be made of a wide variety of materials (e.g., paper, plastic, latex, elastomeric materials, etc.). It may be constructed from a single piece of material which is folded and or connected on three sides and open on the fourth side. It may also be constructed from two separate pieces of material which are connected on three sides and open on the fourth. The collar 25 may be affixed to the inside or the outside of the material. The material may be wider than, narrower than or the same width as the collar 25. The material may be bonded or affixed to the collar 25 flat or gathered. The material may be gusseted. The collar 25 may be affixed before or after the material has been folded to form the container 20 and the skirt 30, when both are constructed from the same material. The collar 25 may be made from a single piece of material which is folded and or connected at one or two ends or two separate pieces which are connected at one or two ends or bonded opposite each other. The collar 25 may incorporate a variety of designs to make grasping and using easter (e.g., recesses and protrusions for holding, etc.). The collar 25 may be made from any number of materials that will function as described (e.g., chipboard, plastic, latex, metal, elastomeric materials, etc.). This invention may be constructed with or without an outer skirt 30. The skirt 30 may be constructed from the same material as the container 20 or from a separate material. The skirt 30 may be constructed to be shorter, longer, or the same size as the container 20. This invention may or may not contain a closing means 35. The closing means 35 may be any of a wide variety of means (e.g., draw-string, draw-tape, adhesive, wire tie, etc.). The packaging-tool 40 may be any one of many types of packaging means that will function as described (e.g., sleeve, box, wrapper, etc.). It may be constructed from any of a variety of materials (plastic, chipboard, elastomeric materials, etc.). The container device may only contain a tool of sufficient strength to stop the movement of waste without having packaging capability. The packaging and the scoop assist tool may be separate items. The invention and all the parts may be constructed in a variety of sizes.

These examples illustrate some of the varying embodiments of this invention. From this description, a number of advantages of the present container device become evident:

1) It is small, light-weight, and easy to carry.

2) It is a flexible container capable of holding a significant volume of waste.

3) The collar allows the user to quickly open, close and manipulate the opening of the container to facilitate collection.

4) The collar allows the user to collect the waste without actually touching it.

5) The skirt effectively protects the user and the outside of the container from accidental contamination when in use.

6) The packaging-tool provides an effective means to stop or compensate for the movement of the waste.

7) The draw-tape or draw-string closure provides a quick, effective way to enclose the waste in the container and transport it for disposal.

OPERATION—FIGS. 6A TO 6E

To operate the invention in a simple embodiment:

1) The user removes the container device from the packaging-tool 40 and unfolds it.

2) The user holds the container device by the collar 25 and squeezes inward at the ends to open the container 20. The amount of pressure controls the width of the opening.

3) The user holds the packaging-tool 40 in one hand to stop the waste from moving and the container 20 in the other, and scoops the waste into the container 20, using the collar 25.

4) The user deposits the waste-soiled packaging-tool 40 into the container 20 and may deposit the container 20 into the nearest waste receptacle.

Figure 6A:
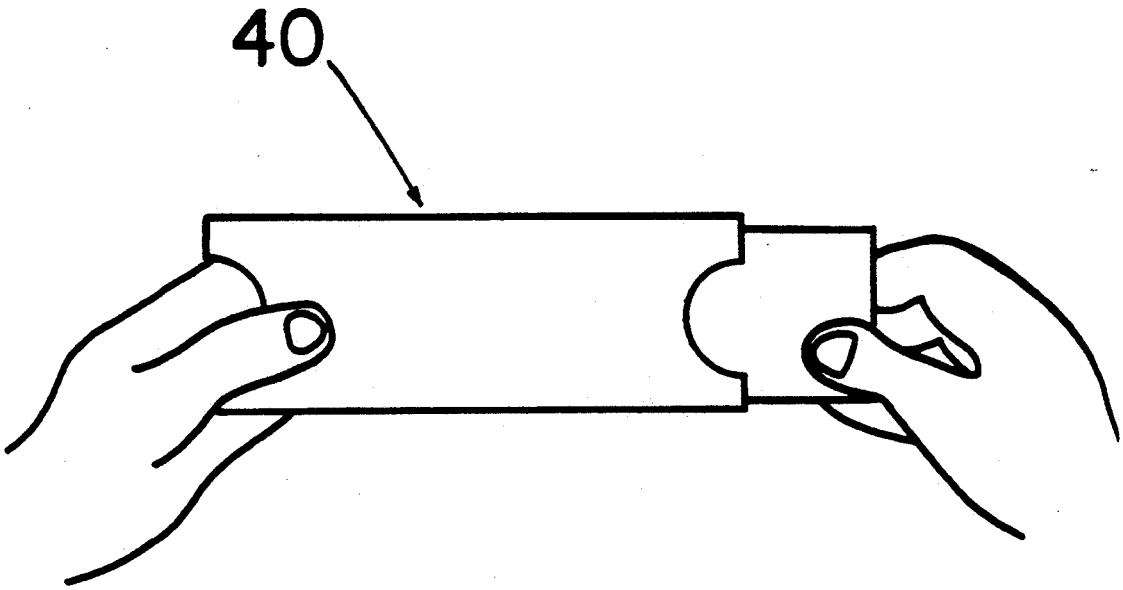
FIGS. 6A to 6E show the operating instructions of the container device in a preferred embodiment.

To operate the container device in a preferred embodiment:

1) FIG. 6A. The user removes the container device from the packaging-tool 40 and unfolds it.

Figure 6B:
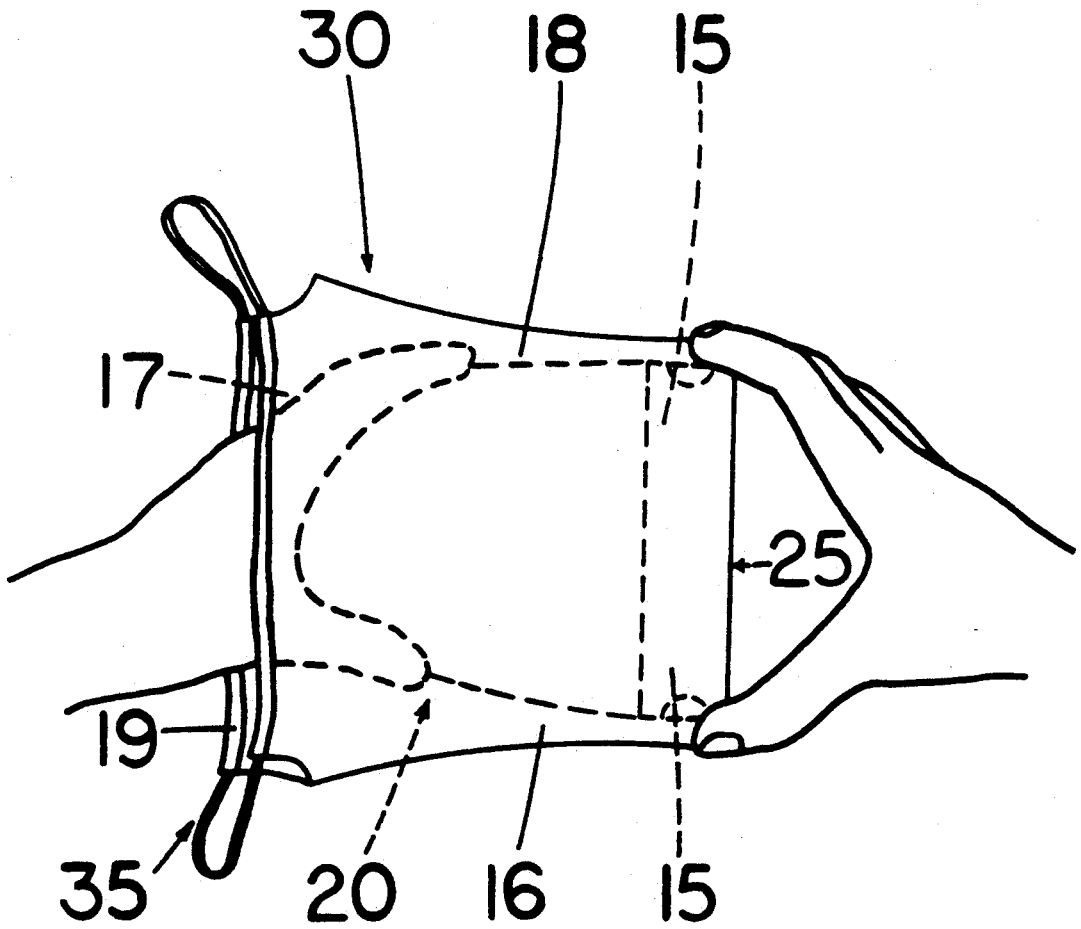

2) FIG. 6B. The user places his hand between the container 20 and the skirt 30 and grasps the collar 25 at the recessed finger areas 15. The user squeezes inward at the ends of collar 25 to open container 20. The user controls the size of the opening with pressure on the collar 25.

Figure 6C:
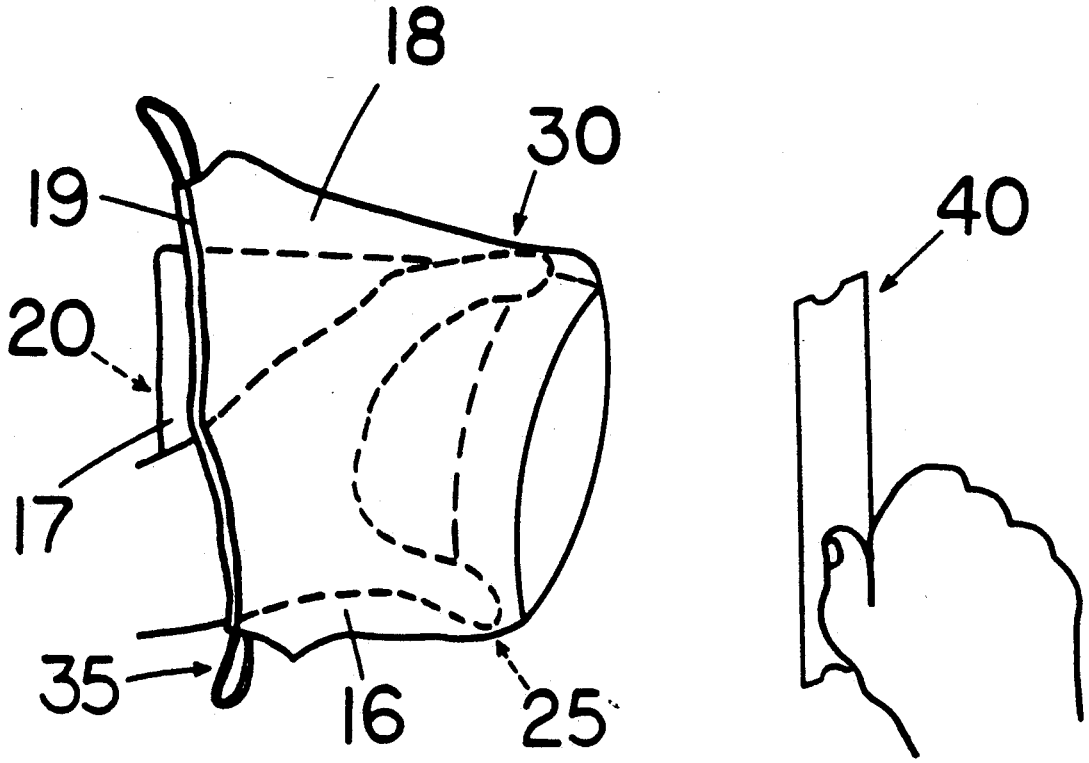

3) FIG. 6C. The user uses the packaging-tool 40 in one hand to stop the waste movement, and the container device in the other hand to scoop the waste into the container 10, with the use of the collar 25.

Figure 6D:
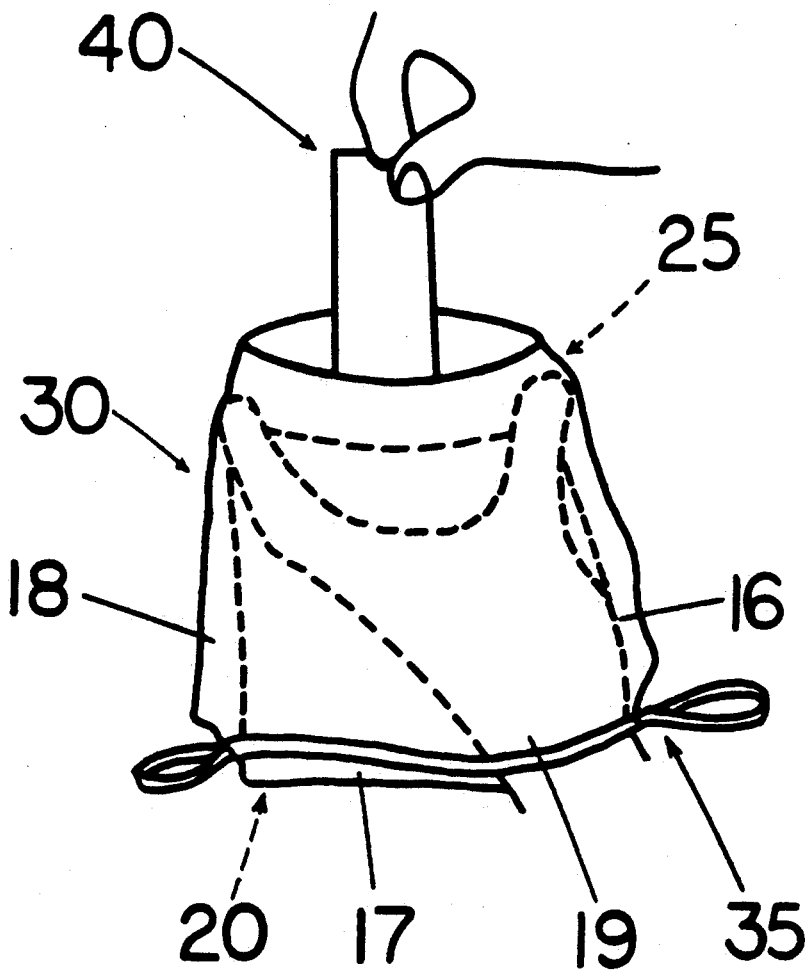

4) FIG. 6D. The user deposits the waste-soiled packaging-tool 40 into the container 20.

Figure 6E:
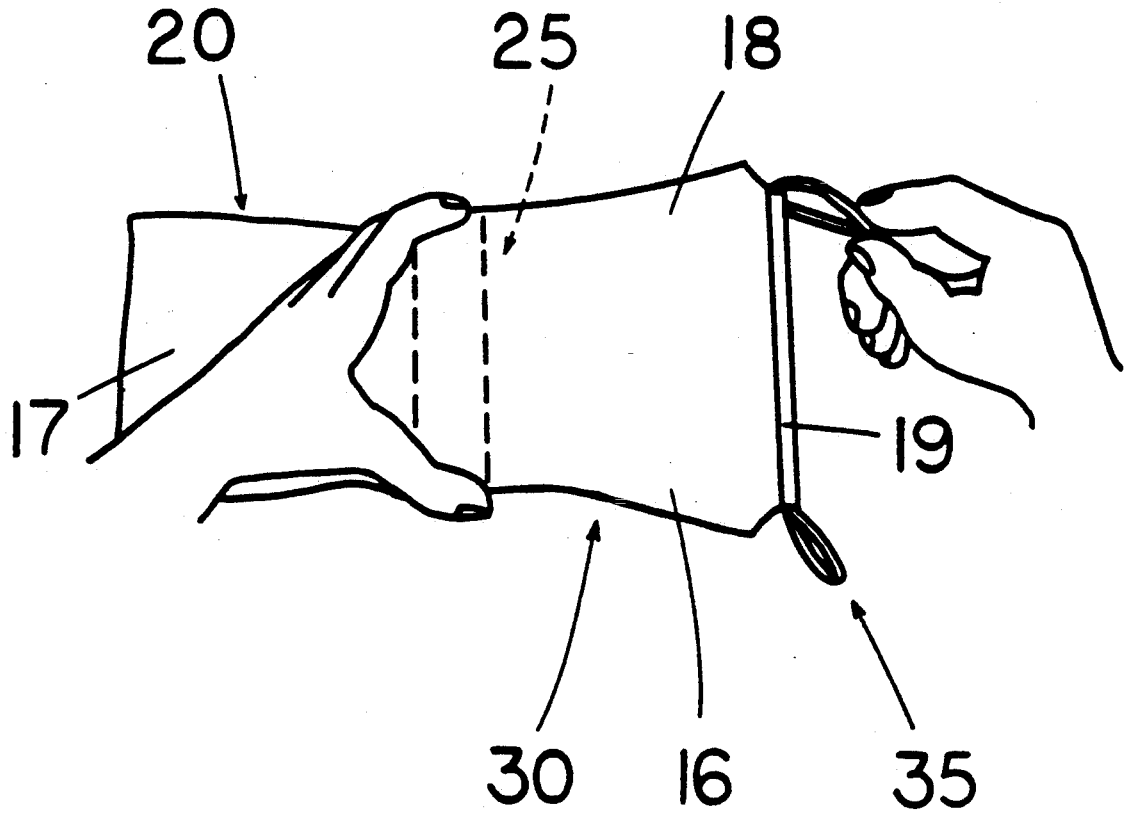

5) FIG. 6E. The user releases the inward pressure on the collar, then uses his free hand to pull the skirt 30 back over the top of the container 20 and collar 25, and uses the draw-string to close the container.

6) The user may deposit the container device into the nearest waste receptacle.

This description shows how conveniently and effectively this invention accomplishes all the objectives previously stated.

1) It is small, light-weight and easy to carry in one's clothing pockets.

2) It is quick and easy to use.

3) It is capable of holding large volumes of waste.

4) It allows the user to modify the shape of the opening to compensate for configuration of the waste.

5) It protects the user from contamination during and after use.

6) It is quick and easy to close and carry for disposal.

7) It provides the means of stopping and handling the movement of waste in a scooping situation.

8) It is easy and inexpensive to manufacture.

Although the above description contains many specificities, these do not limit the scope of the invention, but merely provide illustrations of some of the preferred embodiments of the invention. For example, the collar could be made from an extruded plastic, die cut for shape and having enough memory to cause it to open when removed from the packaging-tool.

I claim:

1. A container for scooping and containing solid waste comprising:

flexible container means for containing solid waste, said container means formed from flexible material having an opening for receiving said waste, said flexible material extending from an attached variable opening means for varying the size and configuration of said opening; and said attached variable opening means being affixed to said flexible container material at said opening, and adapted for spreading open said flexible container material, at said opening, to various configurations, thereby adapting said opening to receive solid waste of varied configurations within said opening, said opening means formed from two elongate continuous sides of firm, flexible material, each side having two spaced ends, each side affixed to an opposite, adjacent side of said container material at said opening, said elongate sides of firm, flexible material having a length aligned with said opening and a width substantially perpendicular to said opening, said length being shorter than a width of said flexible container material and said length of each elongate side being substantially larger than said elongate side width, and having sufficient flexibility such that both of said elongate sides of firm, flexible material can be grasped at their ends, in one hand, to spread and bow said sides outwardly, under varied inward hand compression, thereby varying the size and configuration of the opening defined by said elongate sides of material, and readily adapting the opening for scooping solid wastes of varied sizes and configurations, while scooping the waste into the opening in said flexible container.

2. The container of claim 1, wherein said variable opening means further includes a recess means, in said ends of said elongate sides, for aiding to grip said elongate sides, to vary the size and configuration of said opening.

3. The container of claim 2, wherein said container further includes packaging means for forcing said waste over one of said elongate sides and into said flexible container means, said packaging means formed from a material of sufficient strength to assist in the scooping of waste, said packaging means adapted to receive said container means therein prior to use.

4. The container of claim 3, wherein said packaging means comprises a sleeve means for completely receiving said container means, prior to use.

5. The container of claim 1, wherein said container means further includes a skirt of flexible material joined to said container means at said opening, and extending completely around the outside of said container, from said opening, the width of said skirt being greater than the length of the variable opening means, whereby said skirt is adapted to cover a hand of a user while scooping solid waste over one of said elongate sides of material.

6. The container of claim 5, wherein said skirt further includes means for closing said container means, after covering said opening with said flexible skirt material.

7. The container of claim 6, wherein said closing means comprises a draw-tape movably received within a hem of said skirt material.

8. The container of claim 5, wherein said container means and said skirt are both constructed from a single, continuous bag-shaped flexible material which is folded partly inside-out to form said skirt and said container means.

9. A container for scooping and containing solid waste comprising:

a flexible container material adapted to contain solid waste and having an opening for receiving said waste;

a collar of firm, flexible material affixed to said flexible material at said opening, said collar including opposed, coextensive sides each having a length aligned with said opening substantially larger than a width, and each side having opposite ends, said sides affixed parallel and adjacent each other to define said opening, such that both collar sides can be gripped at said ends between a thumb and finger of one hand such that compressive force applied by said thumb and finger will manipulate said opening, causing the collar sides to open said container to variable sizes and configurations such that the collar can be used to scoop said waste, of various sizes and configurations, into the opening; and a skirt of flexible material extending from said opening and adapted to extend completely around said container, said skirt of flexible material being wider than the length of said collar, whereby the skirt of material is adapted to surround the thumb and finger in contact with said collar during waste scooping to protect the user of the container from direct contact of said waste.

10. The container of claim 9, wherein said collar further includes a recess, in each of said opposite ends, for aiding to grip said collar sides, to vary the size and configuration of said opening.

11. The container of claim 9, wherein said container further includes packaging means for forcing said waste over one of said collar sides and into said flexible container material, said packaging means formed from a material of sufficient strength to assist in the scooping of waste, said packaging means being adapted to receive said container therein prior to use.

12. The container of claim 11, wherein said packaging means comprises a sleeve means for completely receiving said container prior to use.

13. The container of claim 9, wherein said skirt further includes means for closing said container, after covering said opening with said flexible skirt material.

14. The container of claim 13, wherein said closing means comprises a draw-tape movably received within a hem of said skirt material.

15. The container of claim 9, wherein said container and said skirt are both constructed from a single, continuous bag-shaped flexible material which is folded partly inside-out to form said skirt and said container.

16. The container of claim 9, wherein said variable opening means further includes a recess means, in said ends of said elongate sides, for aiding to grip said elongate sides, to vary the size and configuration of said opening.

17. A container for scooping and containing solid waste comprising:

a flexible container material for containing solid waste, said material formed to provide an opening for receiving said waste and extending, from an attached collar;

said attached collar of firm, flexible material being affixed to said flexible container material at said opening, said collar including two elongate sides having a length substantially greater than their width, said two sides each having two ends wherein one end of both elongate sides are disposed adjacent each other and another end of both elongate sides are disposed adjacent each other and said elongate sides are affixed to opposed sides of said container material to define said opening, such that a collar side can scoop said waste into said container material, and such that a user of the container can contact two adjacent ends of said elongate collar sides with a thumb and two other adjacent ends of said elongate collar sides with one or more fingers, in one hand, to variably flex open the container material, at said opening, and scoop said waste into the opening by contact with one of said elongate collar sides, and a skirt of flexible material being capable of extending over the thumb and finger used to flex the opening to protect a user from direct contact with said waste.

18. A method of confining solid waste material in a container, without direct contact of the waste material, comprising:

grasping opposing ends of two opposed elongate sides of firm, flexible collar material, defining a container opening, between a thumb and one or more fingers of one hand to bow the opposed elongate sides outwardly, away from each other, and disposing one elongate side of collar material adjacent to said solid waste;

compressing said elongate collar sides sufficiently to manipulate said container opening to adapt a size and configuration of said container opening to scoop said waste into said opening; and said opposed elongate sides of firm, flexible collar material being affixed to adjacent sides of flexible container material at said opening, said container material adapted to contain said solid waste received therein; said elongate sides of collar material having a length aligned with said opening and having a width substantially perpendicular to said opening, with the length substantially larger than the width, and having sufficient flexibility to spread and bow the elongate sides of material outwardly with one hand; said flexible container material being wider than said length of said elongate sides of collar material, and further including the step of disposing the hand over the elongate sides of collar material and under a skirt of flexible container material, extending downwardly from said collar, and grasping said opposite ends of said elongate sides while said hand is covered and protected from direct contact with said waste by said skirt of flexible container material.

19. A container for scooping and containing solid waste comprising:

flexible container means for containing solid waste, said container means formed from flexible material having an opening for receiving said waste, said flexible material extending from an attached variable opening means for varying the size and configuration of said opening; and said attached variable opening means being affixed to said flexible container material at said opening, and adapted for spreading open said flexible container material, at said opening, to various configurations, thereby adapting said opening to receive solid waste of varied configurations within said opening, said opening means formed from two elongate continuous sides of firm, flexible material, each side having two spaced ends, each side affixed to an opposite, adjacent side of said container material at said opening, said elongate sides of firm, flexible material having a length aligned with said opening and a width substantially perpendicular to said opening, said length of each elongate side being substantially larger than said elongate side width, and having sufficient flexibility such that both of said elongate sides of firm, flexible material can be grasped at their ends, in one hand, to spread and bow said sides outwardly, under varied inward hand compression, thereby varying the size and configuration of the opening defined by said elongate sides of material, and readily adapting the opening for scooping solid wastes of varied sizes and configurations, while scooping the waste into the opening in said flexible container.

* * * * *

UNITED STATES PATENT AND TRADEMARK OFFICE

CERTIFICATE OF CORRECTION

PATENT NO. : 5,280,978

DATED : JANUARY 25, 1994

INVENTOR : JAMIE BOHN

It is certified that error appears in the above-identified patent and that said Letters Patent is hereby corrected as shown below:

Column 1, line 38, delete "the" and substitute therefor -- The --;

Column 3, line 24, after "container." insert the following --They may be bonded or affixed to the inside or outside of the container 20A. --;

Column 4, line 21, after "using" delete "easter" and substitute therefor -- easier --;

Signed and Sealed this

Sixteenth Day of August, 1994

*Attest:*

Bruce Lehman

BRUCE LEHMAN

*Attesting Officer*

*Commissioner of Patents and Trademarks*